US009673497B2

(12) United States Patent
Schöninger

(10) Patent No.: US 9,673,497 B2
(45) Date of Patent: Jun. 6, 2017

(54) HIGH FREQUENCY FILTER HAVING FREQUENCY STABILIZATION

(71) Applicant: KATHREIN-AUSTRIA GES.M.B.H., Niederndorf (AT)

(72) Inventor: Bernd Schöninger, Kufstein (AT)

(73) Assignee: Kathrein-Austria Ges.m.b.H, Niederndorf (AT)

( * ) Notice: Subject to any disclaimer, the term of this patent is extended or adjusted under 35 U.S.C. 154(b) by 70 days.

(21) Appl. No.: 14/442,757

(22) PCT Filed: Nov. 14, 2013

(86) PCT No.: PCT/EP2013/003434

§ 371 (c)(1),
(2) Date: May 14, 2015

(87) PCT Pub. No.: WO2014/075801

PCT Pub. Date: May 22, 2014

(65) Prior Publication Data

US 2015/0288044 A1 Oct. 8, 2015

(30) Foreign Application Priority Data

Nov. 15, 2012 (DE) ..... 10 2012 022 411

(51) Int. Cl.
*H01P 1/202* (2006.01)
*H01P 1/205* (2006.01)
(Continued)

(52) U.S. Cl.
CPC ..... *H01P 1/202* (2013.01); *H01P 1/2053* (2013.01); *H01P 7/04* (2013.01)

(58) Field of Classification Search
CPC ..... H01P 1/2053; H01P 1/2056; H01P 7/06
(Continued)

(56) References Cited

U.S. PATENT DOCUMENTS 2,486,129 A 10/1949 Walt et al.
3,955,161 A * 5/1976 MacTurk ..... H01P 1/207 333/208
(Continued)

FOREIGN PATENT DOCUMENTS

AT WO 2010145758 A1 * 12/2010 ..... H01P 1/2053
CA 2 187 829 10/1998
(Continued)

OTHER PUBLICATIONS

English translation of the International Preliminary Report on Patentability and Written Opinion of the International Searching Authority mailed May 28, 2015, issued in corresponding International Application No. PCT/EP2013/003434.
(Continued)

*Primary Examiner* — Dean Takaoka
(74) *Attorney, Agent, or Firm* — Nixon & Vanderhye P.C.

(57) ABSTRACT

A temperature-compensated high frequency filter of coaxial construction comprises at least one resonator having an inner conductor and an outer conductor housing. A compensation device made of a second material has a second coefficient of thermal expansion. The compensation device comprises a wall section, which extends in an axial direction and is variable in length in this direction in the event of a temperature change. The wall section is part of the housing wall configured in the manner of an intermediate layer or an upper-most layer located adjacent to the housing cover. The wall section may extend in an axial direction or in a direction transversely thereto and be variable in length in this direction in the event of a temperature change. The wall section is an integral part of the housing cover or is connected to the housing cover, or forms the housing cover having convex outwardly directed curvature.

20 Claims, 4 Drawing Sheets

(51) Int. Cl.
*H01P 7/04* (2006.01)
*H01P 7/06* (2006.01)

(58) Field of Classification Search
USPC ..... 333/202, 203, 206, 234
See application file for complete search history.

(56) References Cited

U.S. PATENT DOCUMENTS 4,639,699 A * 1/1987 Nishikawa ..... H01P 7/10 333/202
5,304,968 A * 4/1994 Ohtonen ..... H01P 7/04 333/222
5,329,687 A * 7/1994 Scott ..... H01P 1/205 29/527.2
5,867,077 A 2/1999 Lundquist
5,905,419 A * 5/1999 Lukkarila ..... H01P 7/04 333/202
6,407,651 B1 6/2002 Wulff et al.
6,734,766 B2 * 5/2004 Lye ..... H01P 1/2053 333/203
6,801,104 B2 * 10/2004 Zhu ..... H01P 1/2053 333/202
8,633,789 B2 * 1/2014 Schon ..... H01P 1/2084 333/229
2003/0193379 A1 10/2003 Lye et al.
2010/0102902 A1 * 4/2010 Jung ..... H01P 1/2053 333/212
2013/0093539 A1 * 4/2013 Hedemaki ..... H01P 1/2053 333/203
2013/0130519 A1 * 5/2013 Kokkinos ..... H01P 1/2053 439/78

FOREIGN PATENT DOCUMENTS

CN 201 222 530 4/2009
DE 41 13 302 10/1992
EP 0 540 360 5/1993
FR EP 0068919 A1 * 1/1983 ..... H01P 1/205
WO WO 2010/038215 4/2010

OTHER PUBLICATIONS

International Search Report for PCT/EP2013/003434, mailed Feb. 3, 2014, 5 pages.
Written Opinion of the ISA for PCT/EP2013/003434 (non-English), mailed Feb. 3, 2014, 12 pages.

* cited by examiner

-- PRIOR ART --

HIGH FREQUENCY FILTER HAVING FREQUENCY STABILIZATION

This application is the U.S. national phase of International Application No. PCT/EP2013/003434 filed 14 Nov. 2013 which designated the U.S. and claims priority to DE 10 2012 022 411.7 filed 15 Nov. 2012, the entire contents of each of which are hereby incorporated by reference.

The invention relates to a radio-frequency filter of a coaxial construction in accordance with the preamble of claim 1.

In radio systems, in particular in the field of mobile communications, a shared antenna is often used for transmitted and received signals. In this case, the transmitted or received signals each use different frequency ranges, and the antenna has to be suitable for transmitting and receiving in the two frequency ranges. Therefore, to separate the transmitted and received signals, suitable frequency filtering is required, by means of which on the one hand the transmitted signals can be passed from the transmitter to the antenna and on the other hand the received signals can be passed from the antenna to the receiver. Nowadays, radio-frequency filters of a coaxial construction are used inter alia for splitting up the transmitted and received signals or for merging or separating mobile communication bandwidths.

Radio-frequency filters of a coaxial construction comprise coaxial resonators, in which resonator cavities are formed in an external conductor housing, in which cavities internal conductors in the form of internal conductor tubes or cylinders are arranged. The internal conductor tubes each comprise a free end which is adjacent to a cover arranged on the upper side of the housing. When temperature fluctuations occur, the mechanical length of the internal conductor tube changes. Since the mechanical length is inversely proportional to the frequency, the resonance frequency of the filter drops when the mechanical length increases with increasing temperature. This effect can lead, for example for a filter having a resonance frequency of 2.4 GHz, in the event of a temperature difference of 120° C. to a change in resonance frequency of approximately 5.7 MHz.

In the case of temperature changes, a further second effect also occurs. A capacitance (known as the top capacitance) is formed at the free end of the internal conductor, between the cover and the internal conductor tube. Said capacitance also determines the frequency. If the temperature increases, the internal conductor tube and the walls of the external conductor housing expand by the same factor. Since the walls of the external conductor housing are higher than the internal conductor tube, the distance between the internal conductor tube and the cover increases, which leads to a decrease in the top capacitance and an increase in the resonance frequency. This effect thus counteracts the decrease in the resonance frequency on account of the greater mechanical length of the internal conductor tube in the event of temperature increases.

In order to increase the effect of the decrease in the top capacitance in the event of temperature increases, it is known from the prior art to manufacture parts of the internal conductor tube, or even the entire internal conductor, from a different material having a lower thermal expansion coefficient than the external conductor housing. As a result, in the case of a temperature increase the top capacitance becomes smaller still and compensates the effect of the rise in frequency due to the temperature-determined linear expansion. A temperature compensation can be achieved by means of such filters, such that the resonators in the filter have a constant resonance frequency in a specific temperature range. However, this kind of compensation has some disadvantages. Since the internal conductor or parts of the internal conductor consist of a different material from the housing, an impurity always occurs between two materials, even when said materials are soldered together. Aside from production problems, this can also cause intermodulation problems. Moreover, a plurality of different materials have to be combined in the radio-frequency-critical resonator space, it being possible for mechanical tolerances in said space to seriously influence the filter. For example, if an internal conductor is not placed in the filter with a degree of accuracy of a few hundredths of a millimeter, the coupling bandwidth to all the neighbouring resonators changes, which in turn may lead to tuning problems.

U.S. Pat. No. 6,407,651 B1 discloses a radio-frequency filter comprising a temperature compensation device. Said radio-frequency coaxial resonator comprises an external conductor housing having an internal conductor tube axially arranged thereon. The internal conductor tube ends at a distance below a cover closing the external conductor housing. The internal conductor tube is provided with a longitudinal hole which penetrates the internal conductor tube, into which hole a screw can be screwed from below. The screw can be screwed into a counter piece, which has a peripheral edge at a distance from the free end of the internal conductor tube, such that a bellows-shaped element can be inserted between said peripheral edge of the counter piece and the free front edge of the internal conductor tube. In this case, the screw has a thermal expansion coefficient which is lower than the thermal expansion coefficient of the internal conductor tube, which consists of aluminium for example. The bellows-shaped compensation element further consists of a different material from the material of the screw and of the internal conductor tube.

In the event of a temperature increase and a corresponding increase in the axial length of the internal conductor tube, said compensation device ensures that the bellows-shaped compensation element is accordingly pressed closer together, since the length of the overall construction formed by the screw and the counter piece in contrast changes only slightly in overall length.

However, this embodiment also has various disadvantages, since additional elements are required, the bellows-shaped element has to be welded onto the peripheral front wall of the internal conductor tube, etc. Intermodulation problems may also be caused thereby.

A resonant cavity or a loaded cavity resonator having temperature compensation is also known from DE 41 13 302 C2. Said document also relates to a radio-frequency filter of a coaxial construction comprising an external conductor and an internal conductor. A housing cover is arranged adjacent to the free end of the internal conductor. A bow, in the form of a strip, is arranged above the cover, which bow is screwed to the upper peripheral edge of the cylindrical housing of the resonator. A block is inserted between the underside of said bow which faces the cover and the upper side of the cover. The bow has a thermal expansion coefficient and the length of the bow is dimensioned in such a way that, in the event of a temperature increase, the longitudinal extension of the bow becomes greater or increases more significantly than the expansion of the cover located therebelow. This means that the cover, which is deflected convexly inwards into the resonator interior, is no longer deflected so strongly. As a result of this reduction in the deflection, the capacitance between the internal conductor and the cover is reduced, causing the compensation to occur.

A compensation principle which differs therefrom is known from US 2003/0193379 A1. Said document again relates to a microwave filter of a coaxial construction comprising a screw screwed into the cover, which screw can engage at different depths in an axial internal recess of the internal conductor. Said screw element serves, as usual, to adjust the resonator frequency.

In addition, said disclosure describes various compensation devices which consist, in principle, of a plate-shaped compensation disc which is arranged for example on the inside of the cover. Said disc is provided with a through-opening, through which said screw-like adjustment element protrudes. Said disc which is connected to the cover has a different expansion coefficient, so that a bimetallic effect brought about thereby ultimately causes a deformation of the cover, with the result that the distance between the front face of the internal conductor and the inside of the cover and/or the disc-shaped compensation element provided thereon changes within the context of temperature compensation.

A compensation device is also known in principle from U.S. Pat. No. 5,867,077. Said document, however, relates to a cavity filter without an internal resonator, i.e. not a cavity filter of a coaxial construction comprising an internal conductor.

In contrast, the object of the invention is to provide a radio-frequency filter of a coaxial construction which is simpler to manufacture and more cost-effective to produce than filters known from the prior art.

This object is achieved according to the features specified in claim 1 and claim 2. The dependent claims describe advantageous embodiments of the radio-frequency filter.

The special feature of the solution according to the invention is based on the fact that the compensation device does not consist of parts which have to be additionally attached, assembled or provided in any other manner in order to bring about the desired compensation effect in the event of a temperature change. The invention proposes that merely the parts of the coaxial cavity filter which are present, i.e. the housing wall surrounding the cavity (at least to a partial height) and/or the cover delimiting the resonator interior (the cover body), consist at least in part of an appropriate material for bringing about, in the event of a temperature change and a change in the length of the used material caused thereby, the desired temperature compensation without any additional device.

According to the invention, this is achieved by means of an appropriately adapted wall portion which is, for example, part of the housing wall of the resonator or part of the cover of the resonator, that is to say those parts which together delimit the resonator interior. These are, therefore, not additional features additionally built on or provided on the outside of the resonator in order to bring about compensation, as is proposed for example in DE 41 13 302 C2. In this case, these are corresponding wall portions which extend in the axial direction of the resonator, or at least having an axial component in the direction of the resonator, and do not extend perpendicularly thereto, as is proposed by the use of an additional plate according to US 2003/0193379.

The radio-frequency filter according to the invention comprises a compensation device which in turn comprises at least one wall portion extending in the axial direction which is connected to a housing wall of the external conductor housing and/or integrated in a housing cover. The housing wall of the external conductor housing consists of a first material which has a first thermal expansion coefficient, whereas the compensation device consists of a second material or comprises a second material which has a second thermal expansion coefficient which is greater than the first thermal expansion coefficient of the first material. In the case of a temperature increase, a distance between a free end of the internal conductor and at least one portion of the housing cover increases, and in the event of a temperature decrease the distance between the free end of the internal conductor and the at least one portion of the housing cover decreases. In this case, the axial direction is the axial direction with regard to the internal conductor, and thus parallel to the longitudinal extension of the internal conductor.

Since the second thermal expansion coefficient of the second material is greater than the first thermal expansion coefficient of the first material, and since the compensation device comprises a wall portion made from the second material which extends in the axial direction, the distance of the at least one portion of the housing cover changes more, in the event of a temperature change, than if the compensation device did not comprise any wall portion made from the second material extending in the axial direction. As a result, the internal conductor can consist, for example, of the same material as the external conductor housing and in particular the housing wall, such that the axial length of the internal conductor extends less, on account of the temperature increase, than the wall portion of the compensation device extending in the axial direction.

Since the internal conductor does not have to consist of a material which has a lower thermal expansion coefficient than the housing wall, the external conductor housing can in particular be formed in one piece with the internal conductor, such that the production costs are reduced. In addition, no expensive materials having a low thermal expansion coefficient need to be used for the internal conductor. Due to the possible single-piece construction of the external conductor housing and the internal conductor, intermodulation problems at any contact points between the internal conductor and the housing base are also eliminated.

The radio-frequency filter according to the invention thus achieves, by comparatively simple means, an increase in the distance between the internal conductor tube and the cover in the event of a temperature increase, such that the dropping resonance frequency of the filter as a result of the mechanical elongation with increasing temperature is compensated, since the distance between the free end of the internal conductor and the at least one portion of the housing cover increases disproportionately.

The compensation device preferably comprises a compensation element which comprises the wall portion extending in the axial direction and which is arranged between the housing wall and the housing cover.

A corresponding compensation device is very simple to produce as part of the housing wall and can be arranged in any region of the housing wall. A correspondingly constructed radio-frequency filter is consequently particularly simply constructed and therefore particularly cost-effective.

The compensation element is preferably mechanically connected to the housing wall in the region of the free end thereof and to the housing cover.

Consequently, the compensation element is arranged between the free end of the housing wall and the housing cover. A corresponding compensation element is particularly simple to produce and is therefore particularly cost-effective.

The compensation element can be arranged, for example in the form of an intermediate layer or in the form of an intermediate ring, between the housing cover and the housing wall.

The internal conductor is preferably configured as an internal conductor tube having a longitudinal recess. Furthermore, the housing cover preferably has a housing cover opening and the compensation device comprises a compensation ring which comprises the wall portion extending in the axial direction. In this case, the compensation ring is connected to the housing cover on an outer side thereof facing away from the internal conductor and forms a common passage together with the housing cover opening. The resonator further comprises a pin which is held by means of the compensation ring, wherein the pin protrudes through the common passage of the housing cover and the compensation ring into the longitudinal recess of the internal conductor tube.

A corresponding embodiment of the radio-frequency filter is particularly simple and cost-effective to produce, since the compensation element consists merely of a compensation ring.

The pin is preferably configured as a tuning element which is held by the compensation ring in such a way that the axial position of said element can be changed, so that a penetration depth of the tuning element in the longitudinal recess of the internal conductor tube is variable. The compensation ring consists, in this case, of metal or of a metal-coated plastics material.

The resonance frequency of a correspondingly constructed radio-frequency filter is particularly simple to adjust.

The compensation device preferably comprises a bulge in the housing cover, oriented away from the internal conductor, the bulge comprising the wall portion extending in the axial direction.

Consequently, the compensation device is formed as an integral component of the housing cover and is therefore particularly simple and cost-effective to produce. Due to the special shape of the housing cover, comprising a bulge, the length of the wall portion extending in the axial direction increases in the event of a temperature increase, while the length of the wall portion extending in the axial direction decreases in the event of a temperature decrease. As a result, the distance between the free end of the internal conductor tube and at least one portion of the housing cover increases in the event of a temperature increase, while the distance between the free end of the internal conductor and at least one portion of the housing cover decreases in the event of a temperature decrease.

The wall portion of the bulge extending in the axial direction preferably extends, in a plan view of the resonator, at a distance from the housing wall and from the internal conductor.

In a corresponding configuration of the compensation device, in the event of a temperature change the distance between the free end of the internal conductor and the at least one portion of the housing cover changes in both the axial direction and the radial direction.

The wall portion extending in the axial direction preferably extends towards the housing base and, in a plan view of the resonator, peripherally around the internal conductor at least in part.

As a result, the radial portion of the free end of the internal conductor changes into the at least one portion of the housing cover. Since the compensation device extends only inwards towards the inside of the radio-frequency filter, the filter can have a flat upper side and in addition a smaller size in the axial direction.

The length of the wall portion extending in the axial direction is preferably between 2% and 50%, more preferably between 5% and 35%, more preferably between 10% and 25% of the length, extending in the axial direction, of the housing wall.

Temperature compensation also takes place in the solution according to claim 6. In the case of a temperature-induced expansion of the material of the cover, the walls protruding into the resonator interior (which walls surround the internal conductor completely or in part) creep further outwards in the radial direction, with the result that the distance between said walls and the internal conductor increases and the temperature compensation is thereby brought about.

In the following, the invention will be described in greater detail by way of drawings, in which.

In the following description, like reference numerals denote like components or like features, in such a way that a description made once for one component in reference to one drawing also applies to the remaining drawings, avoiding a repeated description.

Figure 1:
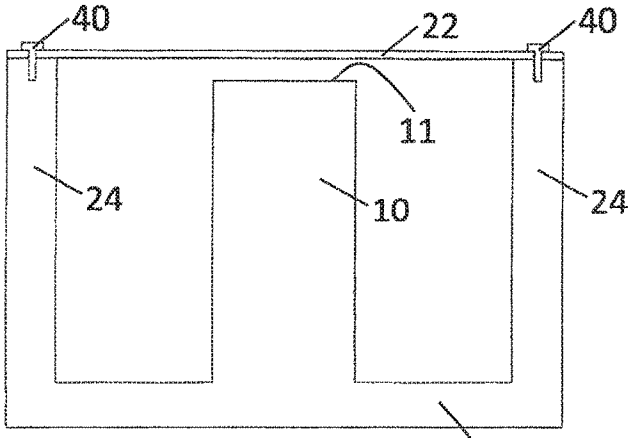
FIG. 1 is a side view of a longitudinal section through a schematically-shown radio-frequency filter known from the prior art.

FIG. 1 shows a radio-frequency filter known from the prior art. In this case, the radio-frequency filter comprises at least one resonator 1, it being possible for the radio-frequency filter to also comprise a plurality of resonators 1 coupled together. Each resonator 1 comprises an internal conductor 10 and an external conductor housing. The external conductor housing comprises, in this case, a housing base 20, a housing cover 22 at a distance from the housing base 20 and a peripheral housing wall 24 between the housing base 20 and the housing cover 22. It can be seen from FIG. 1 that the internal conductor 10 is formed in one piece with the housing base 20 and the housing wall 24. The housing cover 22 rests on the free ends of the housing wall 24 and is mechanically connected to the front faces of the housing wall 24 by means of screws 40. A free end 11 of the internal conductor 10, which represents the front face of the internal conductor 10, is at a predetermined distance from the inside of the housing cover 22.

Since the housing wall 24 is formed in one piece with the housing base 20 and with the internal conductor 10, the housing wall 24 and the internal conductor 10 consist of the same material having the same thermal expansion coefficient. In the event of a temperature increase, the housing wall 24 expands proportionally to the axial length thereof. The same applies to the internal conductor 10, which likewise expands proportionally to the axial length thereof. Since the axial length of the housing wall 24 is greater than the axial length of the internal conductor 10, in the event of a temperature increase the distance between the free end 11 of the internal conductor 10 and the inner wall of the housing cover 22 increases, so that top capacitance decreases, leading to an increase in the resonance frequency. However, since the axial length of the internal conductor 10 increases, the resonance frequency of the filter simultaneously drops, as the mechanical length of the internal conductor 10 is inversely proportional to the frequency.

The corresponding drop in the resonance frequency due to the lengthening of the axial length of the internal conductor 10 is greater than the increase in the resonance frequency accompanying the temperature increase as a result of the drop in the top capacitance, such that the resonance frequency of the corresponding resonator shifts in the event of a temperature increase or in the event of a temperature decrease. In order to increase the distance between the free end 11 and the inner wall of the housing cover 22, it is known from the prior art to manufacture the internal conductor 10 from a material which has a smaller expansion coefficient than the material of which the housing wall 24 consists, so that, in the event of a temperature increase, the housing wall 24 expands more than the internal conductor 10. Corresponding resonators are, however, constructed in a laborious manner, since the resonators have to be connected to the external conductor housing, and intermodulation problems occur at the corresponding connection points.

Figure 2:
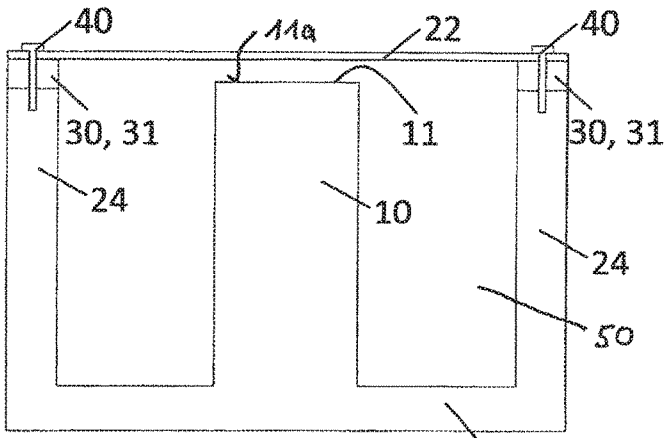
FIG. 2 is a side view of a longitudinal section through a schematically-shown radio-frequency filter according to a first embodiment of the present invention.

FIG. 2 is a schematic side sectional view of a first embodiment of the radio-frequency filter according to the invention. A compensation element 30 is arranged between the housing wall 24 and the housing cover 22. The compensation element 30 is mechanically connected, by means of screws 24, to the housing wall 24 in the region of the free ends thereof and to the housing cover 22.

In this case, the compensation element 30 consists of a material or comprises a material which has a higher thermal expansion coefficient than the material of which the housing wall 24 and the internal conductor 10 consist. The compensation element 30 may be produced in the form of an intermediate plate or a support plate for example, i.e. in the form of an intermediate layer or an uppermost layer. Since the compensation element 30 extends in the axial direction, said element comprises a wall portion 31 extending in the axial direction. In the event of a temperature increase, the compensation element 30 expands, proportionally to the axial length thereof, more than the housing wall 24 and the internal conductor 10, so that the distance between the free end 11, i.e. the front-face end 11*a*, of the internal conductor 10 and the inside of the housing cover 22 increases disproportionately. As a result of the increase in the distance between the free end 11 and the housing cover 22, linked to a rise in temperature, the top capacitance of the corresponding resonator 1 decreases, and so the resonance frequency of the resonator 1 increases. If the axial thickness of the compensation element 30 is appropriately selected and if the material is appropriately selected, in the event of a temperature change, the accompanying change in the resonance frequency can be formed in such a way that said change in the resonance frequency opposes the change in the resonance frequency due to the change in length of the internal conductor and thus compensates said change. As a result, the radio-frequency filter constructed in this way has temperature compensation and frequency stabilisation.

This first embodiment of the invention already shows that the compensation device does not consist of or comprise a separate part attached somewhere, but rather that the compensation device according to the invention consists of a wall portion delimiting the interior of the housing, i.e. the resonator interior 50. In this case, said wall portion shown in FIG. 2 could also be formed at any other point, for example closer to the base 20 in any central region of the housing wall 24 or even in a region directly adjacent to the housing base 20. In every case, a temperature increase leads to an increase in the axial height of the coaxial resonator, with the result that the corresponding distance between the inside of the cover and the front face 11*a* of the internal conductor increases in order to bring about the temperature compensation.

Figure 3:
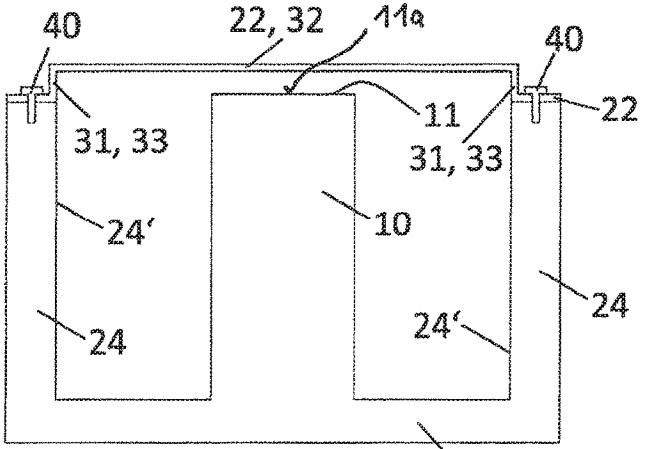
FIG. 3 is a side view of a longitudinal section through a schematically-shown radio-frequency filter according to a second embodiment of the present invention.

FIG. 3 is a schematic side sectional view of a radio-frequency filter according to a second embodiment of the present invention. In this radio-frequency filter or in this resonator 1 the housing cover 22 comprises a bulge 32. The bulge 32 is connected to the remainder of the housing cover 22 via wall portions 31 extending in the axial direction. The housing cover 22 is mechanically connected to free ends of the housing wall 24 in a fastening region outside the bulge 32 by means of screws 40. The housing cover 22, including the bulge 32, and the wall portions 31 consist of a material which has a higher thermal expansion coefficient than the material of which the housing wall 24 and the internal conductor 10 consist. Thus, in the event of a temperature change, the length of the wall portion 31 extending in the axial direction changes disproportionately to a change in the length of the internal conductor 10. In the event of a temperature increase, the axial distance between the free end 11 of the internal conductor 10 and the inner wall of the bulge 32 of the housing cover 22 increases, so that a drop in the resonance frequency due to the lengthening of the axial length of the internal conductor as a result of a disproportionate decrease in the top capacitance of the resonator can be compensated. In the event of a temperature decrease, on the other hand, the distance between the free end 11 of the internal conductor 10, i.e. in this case the front-face end 11*a*, and the inner wall of the bulge 32 of the housing cover 22 decreases, so that a corresponding increase in the resonance frequency due to the decrease in the axial length of the internal conductor 10 can be compensated by a disproportionate increase in the top capacitance of the resonator. It can be seen from FIG. 3 that an inner wall 33 of the bulge 32 extends flush with a housing inner wall 24' of the housing wall 24.

Figure 4:
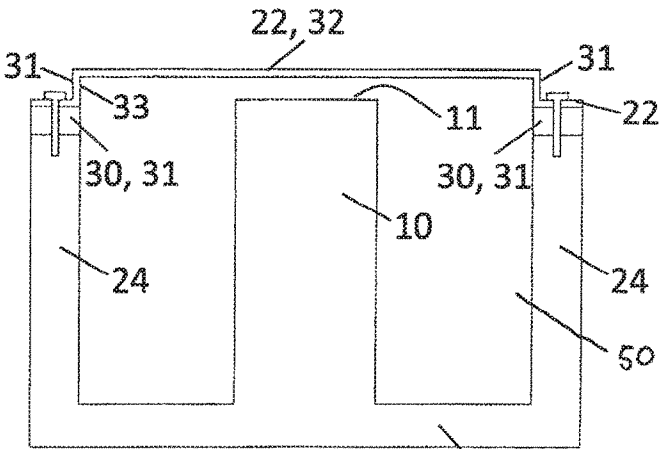
FIG. 4 is a side view of a longitudinal section through a schematically-shown radio-frequency filter according to a third embodiment of the present invention.

FIG. 4 is a schematic side sectional view a third embodiment of the radio-frequency filter according to the invention. The third embodiment is a combination of the first and second embodiments described above. The radio-frequency filter comprises a compensation element 30 which has a wall portion 31 extending in the axial direction. In addition, the housing cover 22 has a bulge 32 which likewise comprises a wall portion 31 extending in the axial direction. Both the compensation element 30 and the housing cover 22, including the bulge 32 and wall portions 31 are made from materials or from one material which have/has a higher thermal expansion coefficient than the material from which the housing wall 24 and the internal conductor 10 are formed. The remainder of the operating principle is identical to the operating principle of the above-described radio-frequency filter according to the first and second embodiments.

Figure 5:
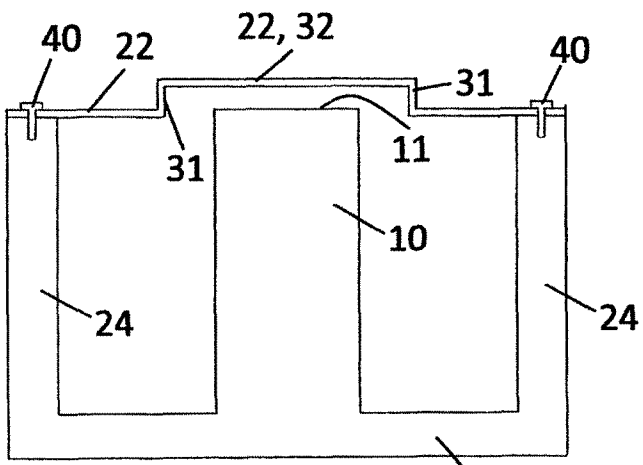
FIG. 5 is a side view of a longitudinal section through a schematically-shown radio-frequency filter according to a fourth embodiment of the present invention.

FIG. 5 is a schematic side sectional view of a radio-frequency filter according to a fourth embodiment of the present invention. The housing cover 22 comprises a bulge 32 which is connected to the remainder of the housing cover 22 via a wall portion 31 extending in the axial direction. The bulge 32 is formed for example integrally, i.e. in one piece, with the housing cover 22. In a plan view of the resonator 1, the wall portion 31 of the bulge 32 extending in the axial direction extends at a distance from the housing wall 24 and at a distance from the internal conductor 10. As a result, in the event of a temperature change, not only does the distance between the free end 11 of the internal conductor 10 and the inside of the bulge 32 extending in the axial direction change, but the radial distance between the internal conductor 10 and the free end 11 of the internal conductor 10, and the wall portion 31 of the bulge 32 extending in the axial direction also changes. This distance change in the radial direction also influences the top capacitance in the event of a temperature change and can be used to compensate the shift in the resonance frequency as a result of a change in the axial length of the internal conductor 10. The remaining construction of the radio-frequency filter according to the fourth embodiment is identical to the construction of the radio-frequency filter according to the second embodiment.

Figure 6:
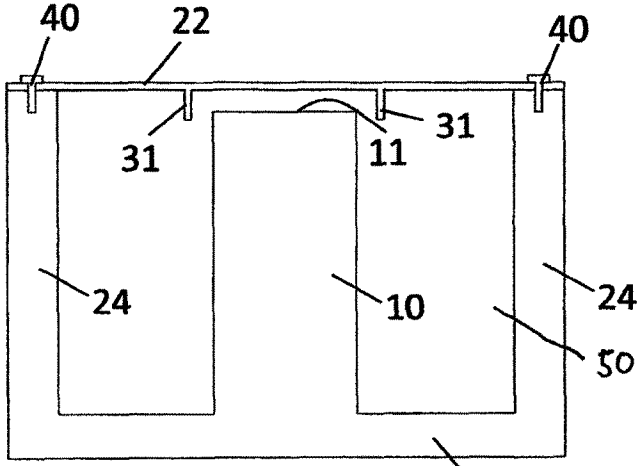
FIG. 6 is a side view of a longitudinal section through a schematically-shown radio-frequency filter according to a fifth embodiment of the present invention.

FIG. 6 is a schematic side sectional view of a fifth embodiment of a radio-frequency filter according to the invention. The housing cover 22 comprises a wall portion 31 extending in the axial direction, which extends towards the housing base 20. In a plan view of the resonator 1, the wall portion 31 is formed so as to surround the internal conductor 10 at least in part. In the event of a temperature change, the radial distance between the free end 11 of the internal conductor 10 and the wall portions 31 extending in the axial direction changes. In the event of an increase in temperature, the housing cover 22 also expands in the radial direction, so that the radial distance between the wall portions 31 and the free end 11 of the internal conductor 10 increases, with the result that the top capacitance of the resonator 1 decreases, resulting in an increase in the resonance frequency of the resonator 1. Conversely, in the event of a temperature decrease, the radial distance between the wall portions 31 and the internal conductor 10, and the free end 11 of the internal conductor 10 decreases, so that the top capacitance increases, resulting in a reduction in the resonance frequency.

Figure 7:
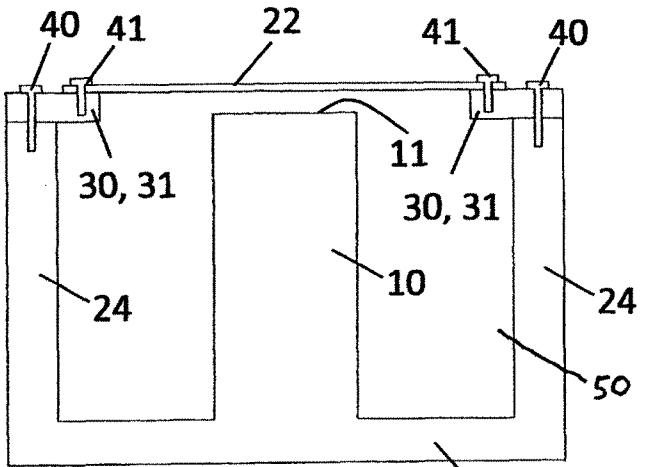
FIG. 7 is a side view of a longitudinal section through a schematically-shown radio-frequency filter according to a sixth embodiment of the present invention.

FIG. 7 is a schematic side sectional view of a sixth embodiment of the radio-frequency filter according to the invention. The radio-frequency filter shown in FIG. 7 is a variation of the radio-frequency filter according to the first embodiment shown in FIG. 2, in which the compensation element 30 has a greater horizontal expansion, so that the compensation element 30 is connected to the housing wall 24 by means of corresponding screws 40, whereas the housing cover 22 is connected to the compensation element 30 by means of further screws 41. The remaining construction is identical to the construction shown in FIG. 2.

Figure 8:
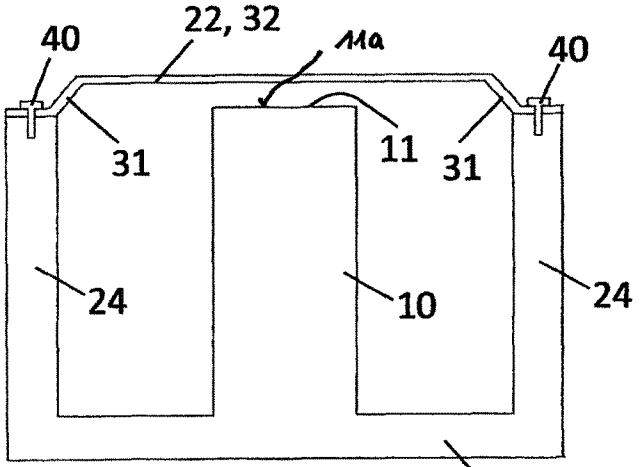
FIG. 8 is a side view of a longitudinal section through a schematically-shown radio-frequency filter according to a seventh embodiment of the present invention.

FIG. 8 is a schematic side sectional view of a radio-frequency filter according to a seventh embodiment of the present invention. The radio-frequency filter shown in FIG. 8 is a variation of the radio-frequency filter according to the second embodiment shown in FIG. 3. In the radio-frequency filter of the seventh embodiment, the wall portion 31 is not formed perpendicularly but rather extends obliquely from the front-face ends of the housing walls 24 in the direction of the internal conductor 10 on the one hand, and oriented away from the housing base 20 on the other hand. The wall portion 31 consequently also comprises a component extending in the axial direction.

Figure 9:
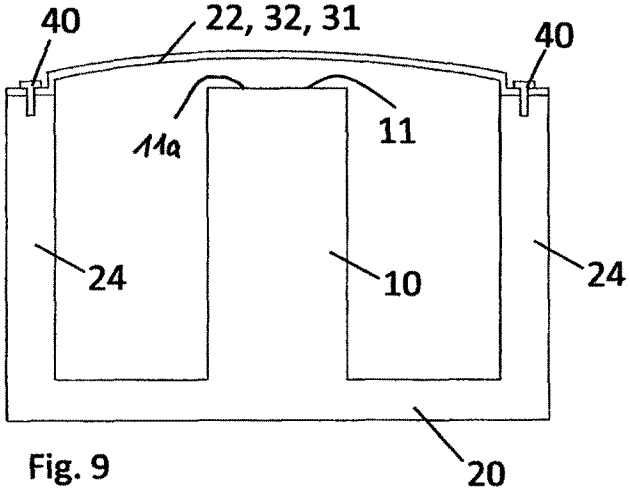
FIG. 9 is a side view of a longitudinal section through a schematically-shown radio-frequency filter according to an eighth embodiment of the present invention.

FIG. 9 is a schematic side sectional view of a radio-frequency filter according to an eighth embodiment of the present invention. In this case, the radio-frequency filter according to the eighth embodiment of the present invention is a variation of the radio-frequency filter according to the second and seventh embodiments. The housing cover 22 of the radio-frequency filter according to the eighth embodiment has a convexly curved shape, so that the wall portion 31 extending in the axial direction extends over the entire housing cover 22. The remainder of the operating principle is identical to the radio-frequency filters according to the second and seventh embodiment.

Finally, it can also be noted that the housing cover 22, when formed as explained from a material having a higher thermal expansion coefficient (i.e. having a higher thermal expansion coefficient than the predominant material of the housing wall 24), also contributes to a more pronounced outward convex bending of the cover overall as a result of the radial length extension thereof in the event of a temperature increase, which ultimately also leads or contributes to an increase in the distance between the inside of the housing cover 22 and the front face 11*a* of the internal conductor 11.

Figure 10:
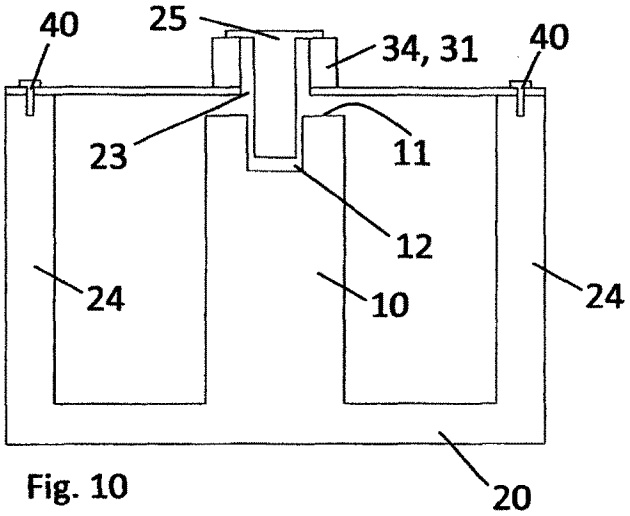
FIG. 10 is a side view of a longitudinal section through a schematically-shown radio-frequency filter according to a ninth embodiment of the present invention.

FIG. 10 is a schematic side sectional view of a radio-frequency filter according to a ninth embodiment of the present invention. In this case, the internal conductor 10 is formed as an internal conductor tube 10 having a longitudinal recess 12. The housing cover 22 has a housing cover opening 23 and the compensation device comprises a compensation ring 34 which comprises the wall portion 31 extending in the axial direction. The compensation ring 34 may be formed in particular from a plastics material, the outside of which is metallised. Alternatively, the compensation ring 34 may also be formed from a metal material having a desired expansion coefficient. In this case, the compensation ring 34 is connected to the housing cover 22 on the outside thereof. The through-opening of the compensation ring 34 forms, together with the housing opening 23, a common passage. In addition, the resonator 1 comprises a pin 25 which is held by the compensation ring 34 in such a way that the pin 25 rests, by means of a support ring, on the front-face end of the compensation ring. The pin 25 protrudes through the common passage of the housing cover 22 and the compensation ring 34 into the longitudinal recess 12 of the internal conductor tube 10. In the event of a temperature change, the penetration depth of the pin 25 into the longitudinal recess 12 of the internal conductor tube 10 changes.

Figure 11:
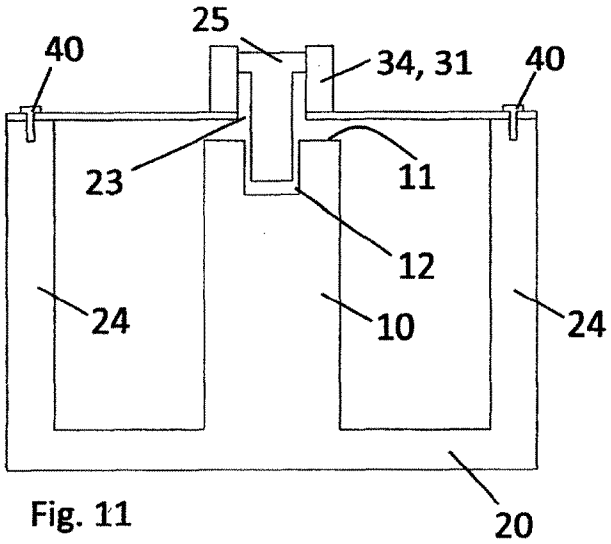
FIG. 11 is a side view of a longitudinal section through a schematically-shown radio-frequency filter according to a tenth embodiment of the present invention.

FIG. 11 is a schematic side sectional view of a radio-frequency filter according to a tenth embodiment of the present invention. The radio-frequency filter according to the tenth embodiment differs from the radio-frequency filter of the ninth embodiment in that the pin 25 is configured as a tuning element 25 which is held by the compensation ring 34 in such a way that the axial position of said element can be changed, so that the penetration depth of the tuning element 25 into the longitudinal recess 12 of the internal conductor tube 10 is variable. For example, the head region of the tuning element 25 may comprise an external thread, whereas the compensation ring 34 comprises an internal thread, so that the penetration depth of the tuning element 25 into the longitudinal recess 12 can be changed by turning the tuning element 25. The compensation ring 34 may for example be formed from a plastics material, the outside of which is metallised. Alternatively, the compensation ring 34 may also be formed from a metal material having a desired expansion coefficient.

Figure 12:
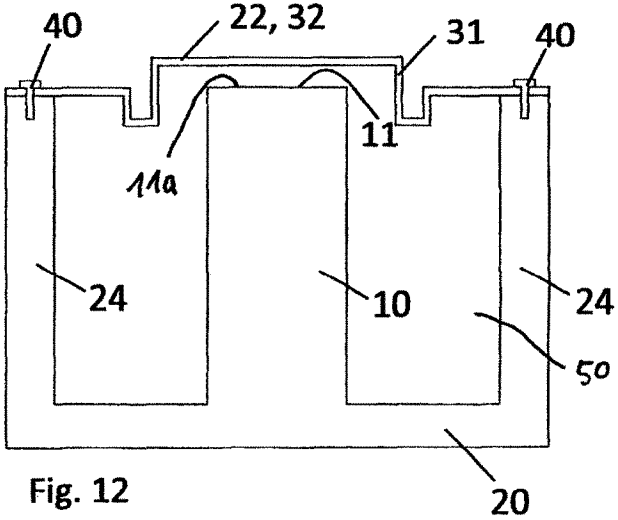
FIG. 12 is a side view of a longitudinal section through a schematically-shown radio-frequency filter according to an eleventh embodiment of the present invention.

FIG. 12 is a schematic side sectional view of a radio-frequency filter according to an eleventh embodiment of the present invention. The radio-frequency filter according to the eleventh embodiment is a variation of the radio-frequency filter according to the fourth embodiment. The housing cover 22 comprises a groove extending around the internal conductor 10, which groove compensates mechanical deformations of the housing cover as a result of temperature changes. The outside of the housing cover consequently comprises a peripheral groove.

Figure 13:
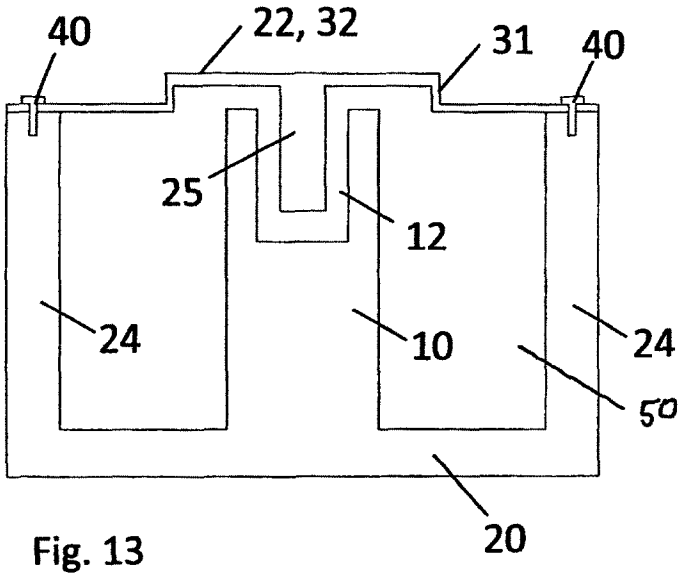
FIG. 13 is a side view of a longitudinal section through a schematically-shown radio-frequency filter according to a twelfth embodiment of the present invention.

FIG. 13 is a schematic side sectional view of a radio-frequency filter according to a twelfth embodiment of the present invention. The radio-frequency filter shown is distinctive in that the internal conductor 10 is formed as an internal conductor tube 10 having a longitudinal recess 12. The housing cover 22 comprises a pin 25 connected thereto which pin protrudes into the longitudinal recess 12 of the internal conductor tube. In addition, the housing cover 22 comprises a wall portion 31 extending in the axial direction, so that, in the event of a temperature change, the penetration depth of the pin 25 into the longitudinal recess 12 of the internal conductor tube 10 is variable.

The various possibilities and modes of operation for how the compensation device can be used, namely by means of the correspondingly explained measures on the external conductor housing or on the housing cover so as to bring about an axial length change, a length change extending obliquely to the axial direction or in the form of a radial length change with respect to wall portions which are provided on the underside or the inside of the housing cover, can be carried out and realised not only as individual measures but also in any desired combination. There are no limitations in this respect.

In the case of all of the above-described radio-frequency filters, the external conductor housing may be formed, for example, of aluminium, brass, invar steel, cast aluminium or metallised plastics material. The housing cover 22 may be formed, for example, of aluminium or of metallised acrylonitrile butadiene styrene (ABS plastics material). The internal conductor may be formed of the same materials as the external conductor housing and may in addition be formed of iron, steel or brass.

The invention claimed is:

1. A radio-frequency filter of coaxial construction, comprising:

at least one resonator having an internal conductor and an external conductor housing;

the external conductor housing comprising a housing base, a housing cover arranged at a distance from the housing base, and a peripheral housing wall extending between the housing base and the housing cover, the wall comprising a first material which has a first thermal expansion coefficient;

the internal conductor galvanically connected to the housing base and extending in an axial direction from the housing base towards the housing cover;

the internal conductor ending at a distance from the housing cover and/or being galvanically separated from the housing cover;

a compensation device formed from a second material which has a second thermal expansion coefficient, the second thermal expansion coefficient of the second material being greater than the first thermal expansion coefficient of the first material; and upon a temperature increase, a distance between a free end of the internal conductor and at least one portion of the housing cover increases and, upon a temperature decrease, the distance between the free end of the internal conductor and the at least one portion of the housing cover decreases;

the compensation device formed as an integral component of the housing and comprising a wall portion that a) extends in the axial direction and changes in length in said direction in the event of a temperature change, the wall portion being part of the housing wall and being configured in the form of an intermediate layer or an uppermost layer lying adjacent to the housing cover, and/or b) extends in the axial direction or in a direction which extends obliquely thereto and can be changed in length in said direction in the event of a temperature change, the wall portion being an integral part of the housing cover, or forming the housing cover having a convex curvature oriented outwards.

2. The radio-frequency filter according to claim 1, wherein the compensation device comprises the housing cover having at least one wall portion which, in a plan view of the resonator, extends around the internal conductor at least in part and protrudes into the resonator interior, a radial distance of the wall portion from the free end of the internal conductor changing as a function of a temperature change.

3. The radio-frequency filter according to claim 1, wherein the compensation device comprises a compensation element which comprises the wall portion extending in the axial direction and which is arranged between the housing wall and the housing cover.

4. The radio-frequency filter according to claim 3, wherein the compensation element is mechanically connected to the housing wall in the region of the free end thereof and to the housing cover.

5. The radio-frequency filter according to claim 3, wherein the compensation element exerts a force on the housing cover, which force is directed, in the event of a temperature increase, substantially away from the free end of the internal conductor and, in the event of a temperature decrease, substantially towards the free end of the internal conductor.

6. The radio-frequency filter according to claim 1, wherein the internal conductor is formed as an internal conductor tube having a longitudinal recess.

7. The radio-frequency filter according to claim 1, wherein the compensation device comprises a bulge on the housing cover which bulge faces away from the internal conductor, the bulge comprising the wall portion extending in the axial direction.

8. The radio-frequency filter according to claim 7, wherein an inner wall of the bulge extends flush with a housing inner wall.

9. The radio-frequency filter according to claim 7, wherein the wall portion of the bulge extending in the axial direction extends, in a plan view of the resonator, at a distance from the housing wall and from the internal conductor.

10. The radio-frequency filter according to claim 2, wherein the wall portion extending in the axial direction is provided or is formed on the side of the housing cover facing the resonator interior and extends towards the housing base at least at a partial height of the internal conductor in such a way that, in an axial plan view of the radio-frequency filter, the cross-sectional shape of the internal conductor is located within the wall portion.

11. The radio-frequency filter according to claim 1, wherein a first material comprises aluminum and/or brass and/or invar and/or glass fiber reinforced plastics material and a second material comprises aluminum and/or acrylonitrile butadiene styrene.

12. The radio-frequency filter according to claim 1, wherein the second thermal expansion coefficient is at least 50%, greater than the first thermal expansion coefficient.

13. The radio-frequency filter according to claim 1, wherein the housing cover is formed of plastics material which is coated with metal, at least on a side thereof facing the housing base.

14. The radio-frequency filter according to claim 1, wherein the external conductor housing is formed in one piece with the internal conductor tube, as a milled part, a cast part or an injection-molded plastics part.

15. The radio-frequency filter according to claim 1, wherein the radio-frequency filter comprises at least two resonators, which are configured and coupled so as to form a duplex filter.

16. The radio-frequency filter according to claim 1, wherein the resonators are configured and coupled so as to form a band-pass filter or band-stop filter.

17. A radio-frequency filter resonator comprising:

an internal conductor and an external conductor comprising at least a portion of a housing;

the housing comprising a housing base, a housing cover, and a peripheral housing wall having an integral temperature-compensating portion, the housing cover being disposed at a distance in an axial direction from the housing base, the peripheral housing wall extending between the housing base and the housing cover, the peripheral housing wall and the temperature-compensating portion formed as one-piece, the temperature-compensating portion of the housing wall extending from the housing wall toward the housing cover, a space being defined within the housing between the housing base and the housing cover, the housing wall comprising a first material having a first thermal expansion coefficient, the temperature-compensating portion of the housing wall comprising a second material having a second thermal expansion coefficient greater than the first thermal expansion coefficient, the internal conductor being disposed in said space, the internal conductor being galvanically connected to the housing base and extending in the axial direction from the housing base towards the housing cover, the internal conductor having a distal portion that is spaced from the housing cover by a distance D that changes directly proportionally to temperature change;

the temperature-compensating portion changing in length in said axial direction in response to said temperature change to compensate for said changes in distance D.

18. The resonator of claim 17 wherein the temperature-compensating portion comprises an intermediate or uppermost layer of the housing wall disposed adjacent to the housing cover.

19. The resonator of claim 17 wherein the temperature-compensating portion extends in the axial direction or in a direction which extends obliquely thereto and changes in length in the direction in which it extends in response to temperature change.

20. In a coaxial radio-frequency filter comprising:

a resonator comprising an internal conductor and an external conductor formed as one piece from a first material having a first thermal expansion coefficient, the external conductor comprising at least a portion of a housing having a housing base, a housing cover, and a peripheral housing wall extending between the housing base and the housing cover to define a space within the housing wall between the housing base and the housing cover, the internal conductor extending in an axial direction within said space from the housing base towards the housing cover, the internal conductor having a distal portion that is spaced from the housing cover by a distance D that changes directly proportionally to temperature change based on the first thermal expansion coefficient;

an improvement comprising the housing cover having an integral temperature-compensating portion comprising a second material having a second thermal expansion coefficient greater than the first thermal expansion coefficient, the integral temperature-compensating portion having a convex curvature oriented outwardly from the housing, the housing cover and integral temperature-compensating portion being formed in one piece, the temperature-compensating portion dimensionally changing in amount of curvature in response to said temperature change based on the second thermal expansion coefficient to compensate for the change in the distance D due to said temperature change.

* * * * *